US005920271A

United States Patent [19]

Hwang

[11] Patent Number: 5,920,271

[45] Date of Patent: Jul. 6, 1999

[54] RADIO PAGER FOR DISPLAYING TEXT MESSAGE IN DIFFERENT FONTS AND METHOD THEREOF

[75] Inventor: Seon-Woong Hwang, Yongin-gun, Rep. of Korea

[73] Assignee: SamSung Electronics Co., Ltd., Suwon, Rep. of Korea

[21] Appl. No.: 08/769,313

[22] Filed: Dec. 19, 1996

[30] Foreign Application Priority Data

Dec. 27, 1995 [KR] Rep. of Korea ..... 95-59439

[51] Int. Cl.[6] ..... G08B 5/22

[52] U.S. Cl. ..... 340/825.44; 340/825.22; 370/313; 455/38.1; 455/38.4

[58] Field of Search ..... 340/825.44, 311.1, 340/825.2, 825.21, 825.22; 379/56.1; 370/313; 455/38.1, 38.4

[56] References Cited

U.S. PATENT DOCUMENTS

| | | | |
|---|---|---|---|
| 4,962,377 | 10/1990 | Wallace et al. | 340/825.44 |
| 5,005,013 | 4/1991 | Tsukamoto et al. | 340/825.44 |
| 5,066,949 | 11/1991 | Breeden et al. | 340/825.44 |
| 5,107,259 | 4/1992 | Weitzen et al. | 340/825.44 |
| 5,223,831 | 6/1993 | Kung et al. | 340/825.44 |
| 5,297,247 | 3/1994 | Kan | 395/151 |
| 5,321,421 | 6/1994 | Nishida | 345/141 |
| 5,323,148 | 6/1994 | Olazabal et al. | 340/825.44 |
| 5,430,439 | 7/1995 | Bodet et al. | 340/825.44 |
| 5,574,439 | 11/1996 | Miyashita | 340/825.44 |
| 5,577,045 | 11/1996 | Faris et al. | 370/94.1 |

*Primary Examiner*—William A. Cuchlinski, Jr.
*Assistant Examiner*—Yonel Beaulieu
*Attorney, Agent, or Firm*—Robert E. Bushnell, Esq.

[57] ABSTRACT

A pager for receiving a text message from a transmitter and displaying characters corresponding thereto in different fonts. The pager includes a first font read-only-memory having a plurality of predetermined addresses, for storing a first font corresponding to said predetermined addresses; an n-th font read-only-memory having the same plurality of predetermined addresses, for storing an n-th font having the same code as the first font but a different display form from the first font, wherein n≧2; and a controller for checking whether a received code forming the text message is an n-th font conversion code by comparing the received code with a pre-selected n-th font conversion code, for accessing an actual address of the n-th font read-only-memory corresponding to the received code when the received code is the n-th font conversion code so as to read the corresponding font data for a visual display of the read font data.

6 Claims, 6 Drawing Sheets

| COLUMN / ROW | 0 | 1 | 2 | 3 | 4 | 5 | 6 | 7 |
|---|---|---|---|---|---|---|---|---|
| 0 | NUL | DLE | sp | 0 | @ | P | ‘ | p |
| 1 | SOH | DC1 | ! | 1 | A | Q | a | q |
| 2 | STX | DC2 | ” | 2 | B | R | b | r |
| 3 | ETX | DC3 | # | 3 | C | S | c | s |
| 4 | EOT | DC4 | $ | 4 | D | T | d | t |
| 5 | ENQ | NAK | % | 5 | E | U | e | u |
| 6 | ACK | SYN | & | 6 | F | V | f | v |
| 7 | BEL | ETB | ’ | 7 | G | W | g | w |
| 8 | BS | CAN | ( | 8 | H | X | h | x |
| 9 | HT | EM | ) | 9 | I | Y | i | y |
| A | NL | SUB | * | : | J | Z | j | z |
| B | VT | ESC | + | ; | K | [ | k | { |
| C | FF | FS | , | < | L | \ | l | \| |
| D | CR | GS | – | = | M | ] | m | } |
| E | SO | RS | . | > | N | ^ | n | ~ |
| F | SI | US | / | ? | O | _ | o | del |

Fig. 3

| ADDRESS | CONTENT |
|---|---|
| 0X00000<br>0X3FFFF | PROGRAM |
| 0X40000<br>0X41FFF | FIRST FONT AREA |
| 0X42000<br>0X43FFF | SECOND FONT AREA |

Fig. 6

<NEWS> [BIG EARTHQUAKE] HAPPENS IN KOBE, JAPAN, THIS MORNING, AND A HUNDRED PEOPLE ARE DEAD AND WOUNDED

Fig. 7A

<NEWS>
[BIG EARTHQUAKE]
HAPPENS IN
KOBE, JAPAN,
THIS MORNING

Fig. 7B

<NEWS>
BIG EARTHQUAKE
HAPPENS IN
KOBE, JAPAN,
THIS MORNING

Fig. 7C

<NEWS>
[BIG EARTHQUAKE]
HAPPENS IN
KOBE, JAPAN,
THIS MORNING

Fig. 7D

RADIO PAGER FOR DISPLAYING TEXT MESSAGE IN DIFFERENT FONTS AND METHOD THEREOF

CLAIM FOR PRIORITY UNDER 35 U.S.C. §119

This application makes reference to, incorporates the same herein, and claims all benefits accruing under 35 U.S.C. §119 from an application for Character Receiving And Displaying Device In Pager And Method Thereof earlier filed in the Korean Industrial Property Office on Dec. 27, 1995 and there duly assigned Ser. No. 59439/1995.

BACKGROUND OF THE INVENTION

1. Technical Field

The present invention relates to a character receiving and displaying pager using different types of fonts, and more particularly, to a pager capable of displaying received characters in different types of fonts and a method thereof.

2. Background Art

Conventional paging systems, which come in various levels of sophistication, are personal message receiving devices which monitor certain broadcast channel used by paging networks to alert or send information to specific subscriber units known as pagers. Exemplary configurations are disclosed, for example, in U.S. Pat. No. 5,381,132 for Method Of Displaying Self-Address Data In A Pager Receiver issued to Yun and U.S. Pat. No. 5,475,380 for Time Alarm Method Of A Radio Paging Receiver issued to Shim, both of which are assigned to the same assignee of the present invention. Each subscriber pager has an individual identification ID stored in the pager. All of the pagers in an area monitor broadcast messages from a base station including a central transmitter. Each message is intended for a particular pager and has that pager's ID associated with the message. Thus, pagers in a particular service area all monitor a certain channel, i.e., frequency for broadcasts from the pager system transmitter looking for its ID. When the ID is present, that is when the ID is broadcast by the central transmitter, the message associated with the ID, which typically follows the ID, is acted upon by the pager.

The most basic type of pager is known as a beeper. The message is simply an instruction to actuate the pager causing the pager to generate the familiar beep, illuminate an LED, or both. Another type of pager system is used to transmit numeric messages, typically a telephone number the recipient is to call. When the individual pager receives its ID, the accompanying message is typically stored in the pager and displayed on the pager's numeric display. More recent pager systems are used to transmit alphanumeric messages which include the number and/or word messages for display immediately or later. Exemplary configurations are disclosed, for example, in U.S. Pat. No. 5,499,020 for Data Display Radio Pager issued to Motohashi et al., U.S. Pat. No. 5,481,255 and U.S. Pat. No. 5,452,356 both for Paging Transmission System issued to David, U.S. Pat. No. 5,323,148 for Selective Call Receiver Presenting The Length Of An Alphanumeric Message Prior To Presentation Of The Message issued to Olazabal et al., U.S. Pat. No. 5,321,421 for Portable Electronic Device Capable Of Receiving And Transmitting Lower-Case Letter Codes While Displaying Only Upper-Case Letters issued to Nishida. Other pager systems such as disclosed, for example, in U.S. Pat. No. 5,223,831 for Ideographical Character Signalling System issued to Kung et al., are also capable of displaying ideographical characters such as languages in China, Japan, Taiwan.

In the conventional pagers which are capable of displaying alphanumeric messages including a telephone number and/or word messages, a 7-bit ISO (International Standard Organizations) character set is typically received as a word message and a data value corresponding to the received character set is read from a font read-only-memory (ROM) for a visual display of the same. For example, Korean characters are represented as a 14-bit complete code using SI and SO. Since the conventional pagers contain only one set of font to represent the characters whether the characters are in English or Korean, only one type of display is available. As a result, if the user requests to bold a part of a message or to use different font sets for decoration or emphasis of the message, the conventional pagers as available today are not equipped to handle those requests.

SUMMARY OF THE INVENTION

Accordingly, it is therefore an object of the present invention to provide an improved pager.

It is also an object to provide a pager capable of receiving a text message and providing a visual display of the text message in a bold style.

It is further an object to provide a pager capable of receiving a text message and providing an enhanced visual display of the text message with different types of fonts.

These and other objects of the present invention can be achieved by a pager for receiving a text message from a transmitter and displaying characters corresponding thereto. The pager includes a first font read-only-memory having a plurality of predetermined addresses, for storing a first font corresponding to said predetermined addresses; an n-th font read-only-memory having the same plurality of predetermined addresses, for storing an n-th font having the same code as the first font but a different display form from the first font, wherein $n \geqq 2$; and a controller for checking whether a received code forming the text message is an n-th font conversion code by comparing the received code with a pre-selected n-th font conversion code, for accessing an actual address of the n-th font read-only-memory corresponding to the received code when the received code is the n-th font conversion code so as to read the corresponding font data for a visual display of the read font data.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 3 is a table illustrating a configuration of a 7-bit ISO code used according to the principles of the present invention;

FIG. 6 illustrates a configuration of a memory for performing the operation as shown in FIG. 5; and FIGS. 7A through 7D are views for explaining a character receiving and displaying example according to the principles of the present invention.

DETAILED DESCRIPTION OF THE PREFERRED EMBODIMENT

Figure 1:
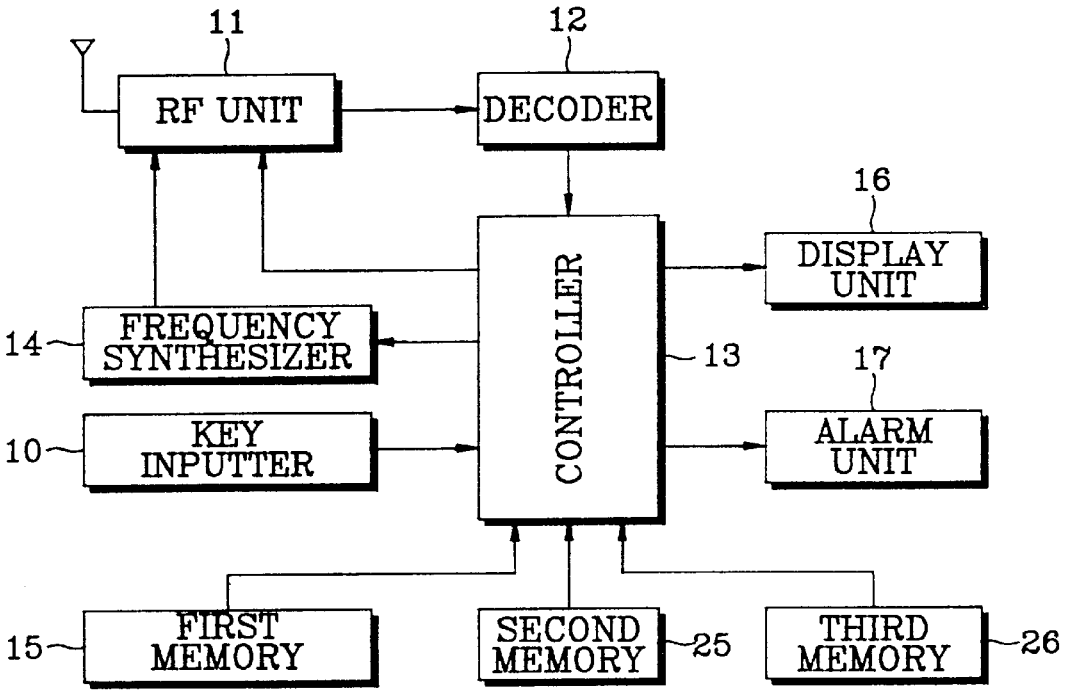
FIG. 1 is a block diagram illustrating a pager constructed according to the principles of the present invention.

Referring now to the drawings and particularly to FIG. 1, which illustrates a pager constructed according to the principles of the present invention. The pager is for selectively receiving a plurality of calling signals which are specific to the pager. Each of the calling signals includes a calling number and a text message following the calling number and is transmitted as a radio signal from a paging terminal (not shown). The calling number represents a number assigned to the radio pager to which the message should be directed.

As shown in FIG. 1, the radio pager has an antenna, a key inputter 10 including alpha-numeric keys and font keys for allowing the user to set the pager for providing an enhanced visual display of the text message in different types of fonts, a radio-frequency (RF) unit 11, a decoder 12, a controller 13 for controlling overall operations including a display of the text message in different types of fonts, a frequency synthesizer 14 for tunning a frequency in which a calling signal can be received, a first memory 15 including a read-only-memory (ROM) for storing a program which controls the overall operations of the pager, a random-access-memory (RAM) for defining a work space needed for pager operations, and an electrically erasable PROM for storing address information and frame information allocated to the pager, a display unit 16 for displaying the text message from a caller and state information of the pager with characters of a various fonts, an alarm memory 26 for alerting the user of an incoming call. Second and third memories 25 and 26 are ROMs for storing various types of font sets. In a preferred embodiment of the present invention, the first, second, and third memories 15, 25, 26 can be integrated in a single memory device having at least three memory locations with a first memory location storing the program for providing a visual display of the text message in different types of fonts, a second memory location representing a first font area, and a third memory location representing a second font area.

In operation, a calling signal coming in through an antenna is amplified and demodulated by the RF unit 11. The RF unit 11 is typically a circuit arrangement comprised of a high frequency amplifier, a frequency converter, an intermediate frequency (IF) amplifier and a discriminator. Although not shown in FIG. 1, the radio section 102 is usually periodically energized by a plurality of preamble search pulses which are applied from the controller 13 for battery saving purposes. The output of the RF unit 11 is then applied, after being wave-shaped, to a decoder 12. The decoder 12 searches for a preamble and a synchronization codeword preceded thereby. If the codeword is detected, the decoder 104 searches for an identification address code by comparing the same with the user's unique code contained in the decoder 12.

When the identification address code contained in the call signal received through the antenna coincides with the user's unique code, the decoder 12 activates the controller 13 and then applies the text message data included in the calling signal received through the antenna to the controller 13. When the controller 13 receives the text message data, a central processing unit (CPU) included therein activates the alarm unit 17 including one of, or a combination of a buzzer (not shown), a vibrator (not shown) and a lamp (not shown) for alerting the user of an incoming call in dependence upon an operation mode, i.e., whether the pager operates in one of an audible alert mode and an inaudible alert mode.

Figure 2:
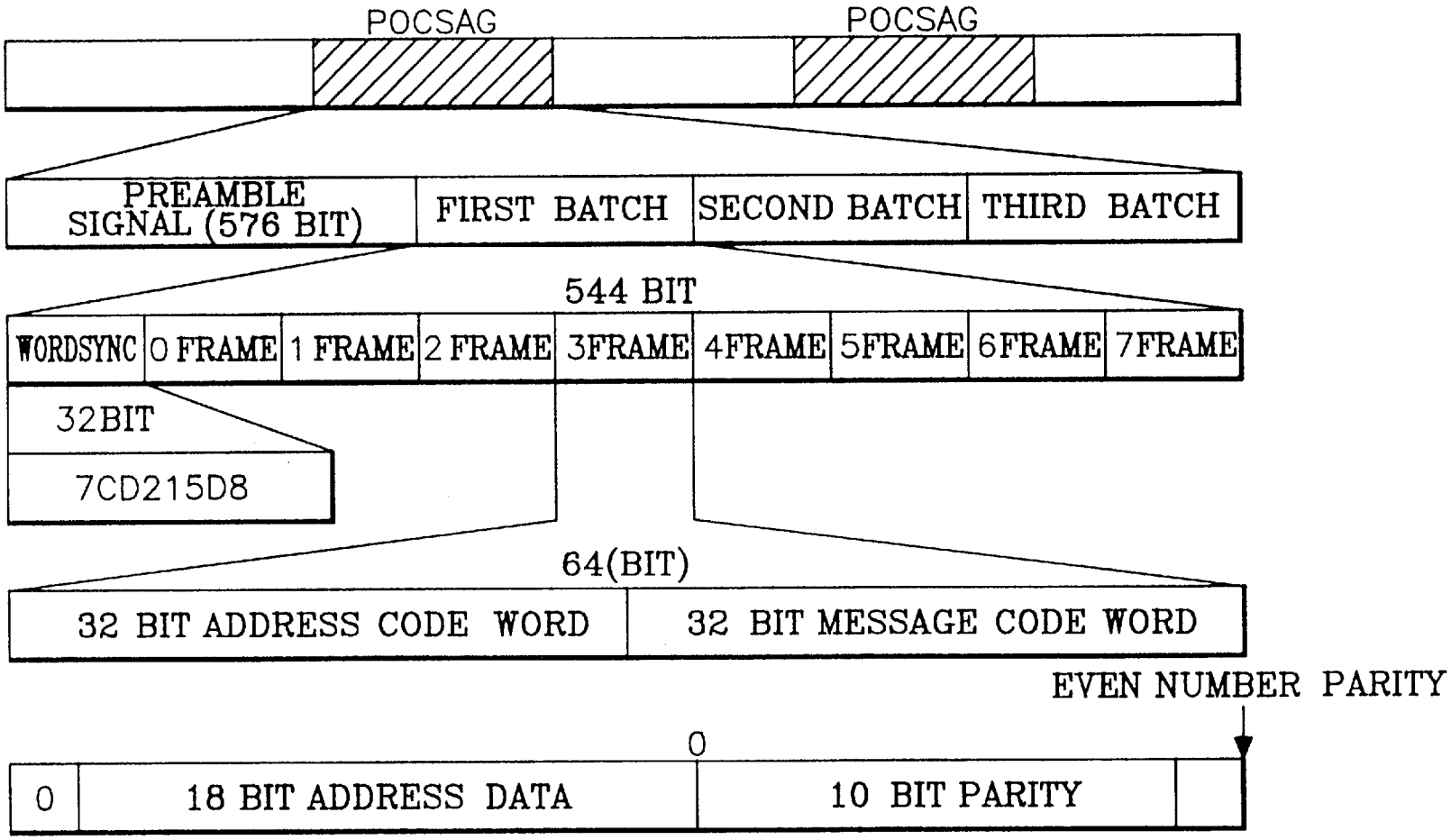
FIG. 2 illustrates a POCSAG code used in the pager as shown in FIG. 1.

FIG. 2 represents a format of a POCSAG code used in the pager constructed according to the principles of the present invention. POCSAG code is a signal type for pagers adopted throughout the world and shown in detail in CCIR recommendation 584.

Each POCSAG code is comprised of a preamble data of 576 bits and a plurality of batch data. Preamble data is a reversal code that 1 and 0 repeat during 576 bits. Each POCSAG code contains at least thirty (30) batches of data up to the maximum of sixty (60) batches. Each batch of data is comprised of word sync data of 32 bits and eight (8) frames of data of 64 bits. Here, the word sync data is 32-bit data of "(7CD215D8)H and (01111100 110100100001010111011 00)B." In addition, each frame data is comprised of an address codeword of 32 bits and a message codeword of 64 bits. Each address codeword is constituted by the address data of eighteen (18) bits, the parity data often (10) bits, one (1) bit for identification of an address codeword, two (2) bits of function bits and one (1) bit of even parity. Thus, each batch is constituted by a 544-bit data (17 words×32 bits=544 bits) of 17 words, with each word is a 32-bit data.

Turning now to FIG. 3 which is a table illustrating a configuration of a 7-bit ISO code used in the pager constructed according the principles of the present invention. When this code is received via a public network, the data stored in an address corresponding to the first or second font ROM (a first or second font area) is to be read. For example, when an address corresponding to a code 'B5' is to be read, data of "[" is read.

Figure 4:
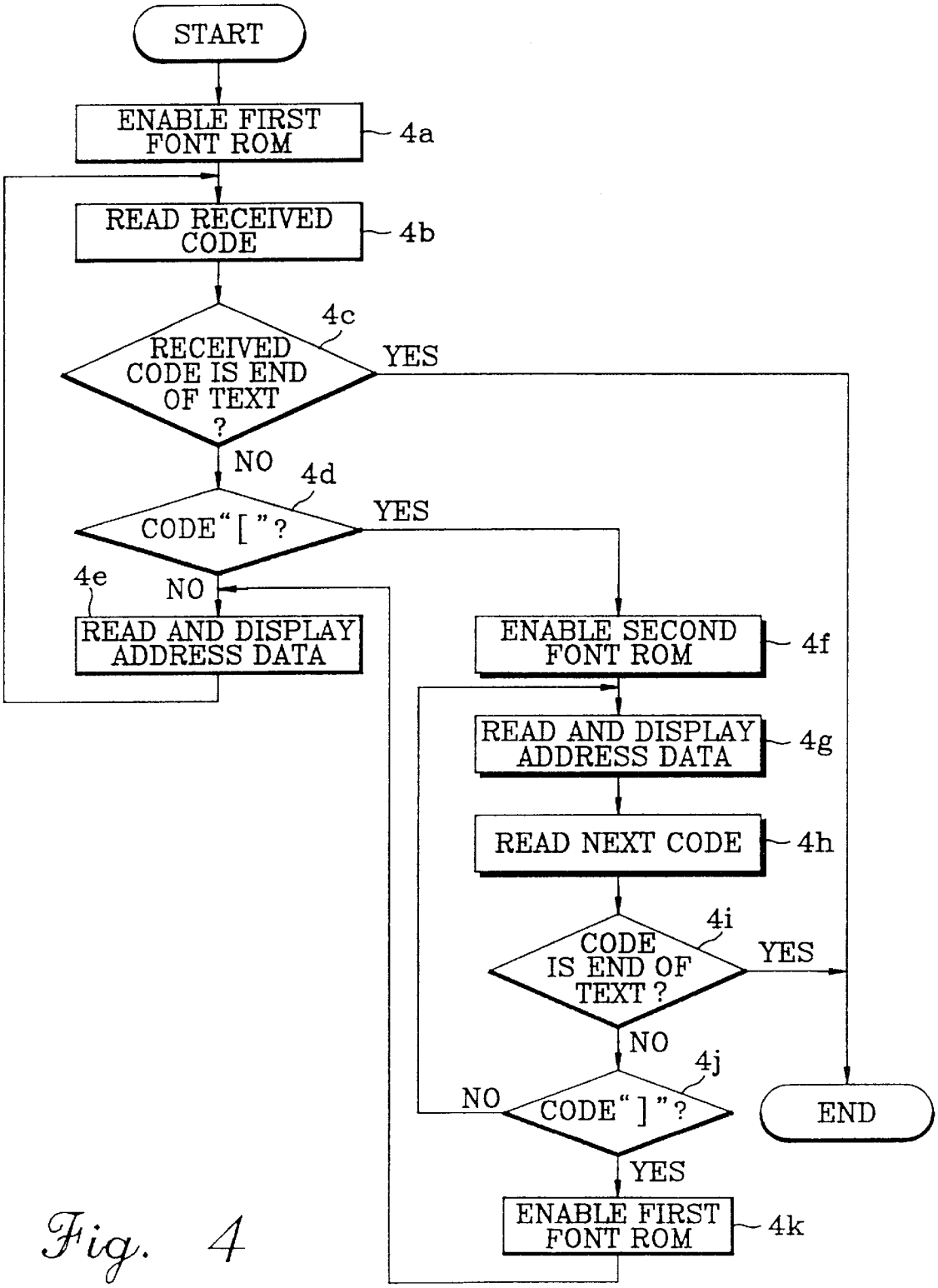
FIG. 4 is a flowchart for explaining a character receiving and displaying process of the pager constructed according to the principles of the present invention.

FIG. 4 is a flowchart for explaining a character receiving and displaying process of the pager according to the present invention, in which a transmitted message as shown in FIG. 7A is displayed, for example, in a bold style as shown in FIG. 7D.

First, the second memory 25 (hereinafter called a first font ROM) is enabled at step 4*a*. The controller 13 reads a received code at step 4*b*, and then determines whether the received code is an end of text (EOT) representing a completion of data transmission at step 4*c*. When the received code is determined not to be the end of text (EOT) at step 4*c*, the controller 13 determines next whether the code is "[" at step 4*d*. In the present embodiment, it is assumed that "[" and "]" are font conversion codes among various font conversion code to be used by the message sender. Special signs which are not frequently used among the codes as shown in FIG. 3 are used because of their relative simplicity and availability to an operator or a modem user. Thus, any signs which can be input through the key inputter 10 can be selected arbitrarily by the user. It is note that the selection of the font conversion code should be in correspondence with the receiver's side.

When the code is determined to be "[" at step 4*d*, a third memory 26 (hereinafter called a second font ROM) is enabled at step 4*f*. In step 4*g*, the corresponding data i.e., "[" is read by accessing an address of the second font ROM 25 corresponding to the code "[" so as to display the read data on the display unit 16. In steps 4*h* through 4*j* and 4*g*, after the next code "B" is read and displayed, this step repeats till "E" is read and displayed on the display unit 16. When the code "[" is found in step 4*j*, the first memory 25 is enabled at step 4*k*. Then, in step 4*e*, the address of the first font ROM

25 corresponding to the code "[" is accessed to read the corresponding data "[" and display the same on the display unit 16.

After performing step 4*e*, "H" is read at step 4*b* in the same way, and by repeating such steps, the process is finished when the received code is determined to be the end of text (EOT).

According to the present embodiment, the addresses of the first font ROM 25 and second font ROM 26 are the same but the fonts stored in the corresponding address is different. For instance, a font "E" is stored in a particular address of the first font ROM 25 and the font "E" of a different type is stored in the same address of the second font ROM 26. Thus, the display type of a character can be differentiated according to the operation of the two font ROMs 25 and 26 by the controller 13.

Figure 5:
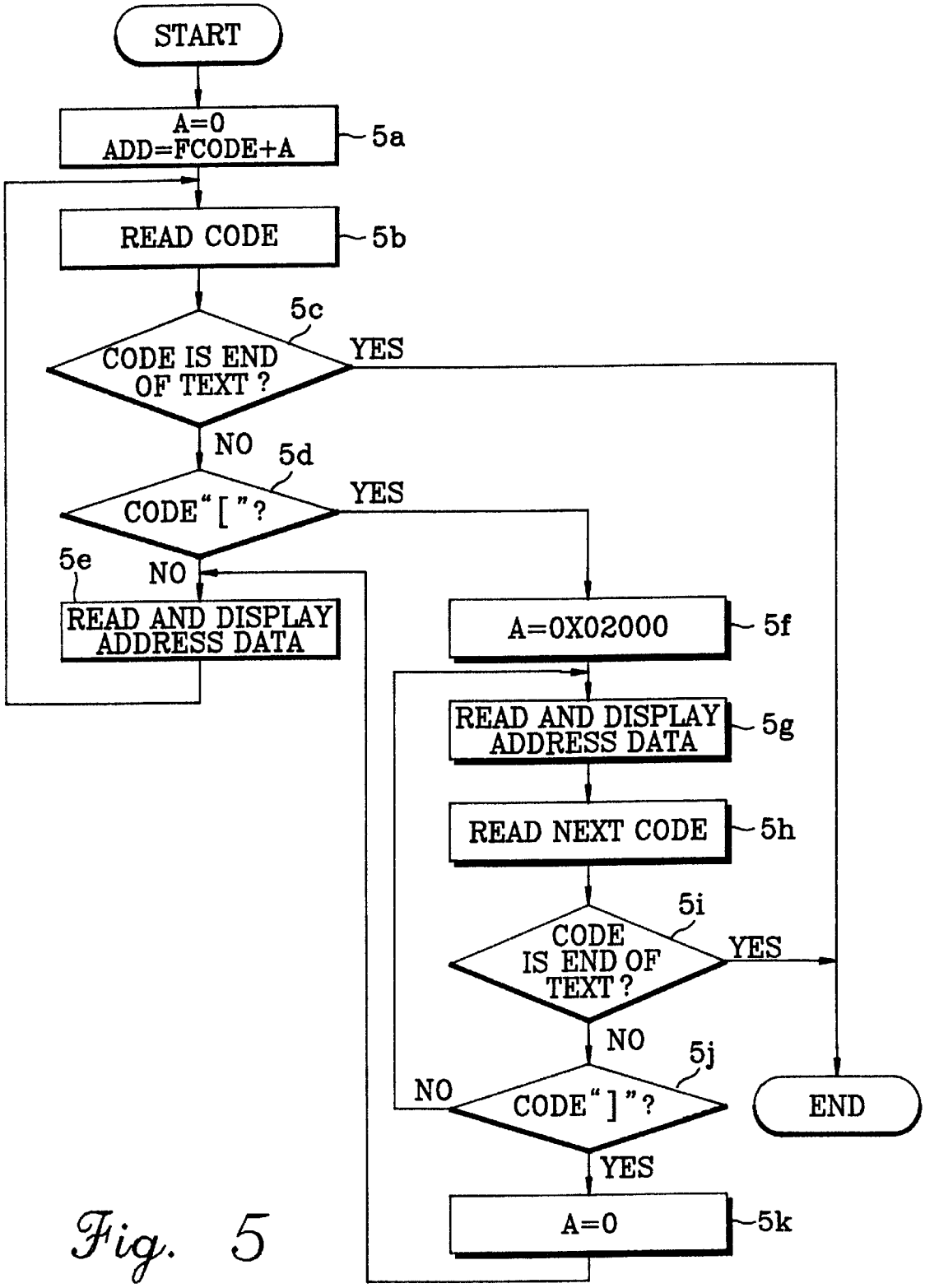
FIG. 5 is a flowchart for explaining a process of receiving and displaying a different character in the pager constructed according to the principles of the present invention.

FIG. 5 is a flowchart for explaining a process of receiving and displaying a different character in the pager constructed according to the principles of the present invention, and FIG. 6 illustrates a configuration of a memory for performing the operation as shown in FIG. 5. According to FIG. 5, a single memory device is used in lieu of the first, second, and third memories 15, 25, 26 as shown in FIG. 2. This memory device includes at least three memory locations with a first memory location storing the program for providing a visual display of the text message in different types of fonts, a second memory location representing a first font area, and a third memory location representing a second font area. In this situation, the areas for the first and second fonts has an address difference of 0X02000.

Thus, in steps 5*a*, 5*f* and 5*k* of FIG. 5, instead of enabling the font ROM by changing the same as in steps 4*a*, 4*f* and 4*k* of FIG. 4, an arbitrary address of the first font area is accessed as it is or the difference value (0X02000) is added to the address so that an address corresponding to the second font area, while the remaining operation is congruous. In FIG. 6, FCODE denotes a place on the ROM area corresponding to the received code unlike the actual ROM address to be read in step 5*a* or 5*g*.

FIGS. 7A–7D are views for explaining a character receiving and displaying example according to the present invention. The example uses a piece of news and the title is processed with another font in mail drop (also with special characters).

FIG. 7A illustrates transmitted data from the paging terminal (not shown). FIG. 7B illustrates a display of the received data in a typical pager whereas FIG. 7C illustrates a first display form and FIG. 7D illustrates a second display form of the received data in the pager constructed according to the principles of the present invention. As shown in FIG. 7D, the received message is displayed as "[BIG EARTHQUAKE]" in a bold style and in a bracket. However, to express the phrase only in a bold style without the bracket as shown in FIG. 7C, the corresponding steps 4*e*, 4*g*, 5*e* and 5*g* in FIGS. 4 and 5 need to be skipped.

In the present embodiment, though the description is made assuming two font ROMs or two font areas in a single memory device, different font sizes or styles such as italics, bold italics, underline will be available by correspondingly increasing the number of the font ROMs or the font areas. The present invention advantageously allows the pager to provide an enhanced visual display of a text message in part or in whole in a bold style or different types of font sets so as to alert the user the importance of certain text messages under consideration.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A pager, comprising:

receiver means for receiving a paging signal including a pager number and a text message;

decoder means having an internal memory storing a pager number assigned to the pager, for comparing the pager number included in said paging signal with the pager number stored in said internal memory, and for beginning operation of the pager when the two pager numbers coincide;

an input unit including a font setting key and a plurality of discrete keys that are independently operable by manual depression by a user;

a display unit;

a memory including a first font location having a plurality of predetermined addresses for storing a first font corresponding to said predetermined addresses, and an n-th font location having said plurality of predetermined addresses for storing an n-th font that is different from said first font, wherein $n \geqq 2$; and a controller for controlling operation of the pager and for allowing the user to set a visual display of the text message in different display forms via said font setting key, said controller controlling the visual display of the text message by:

determining whether a received code of said paging signal forming said text message is an n-th font conversion code by comparing said received code with a pre-selected n-th font conversion code;

calculating a corresponding address of said n-th font location by adding a difference value between address ranges of said first font location and said n-th font location to an actual address of said first font location corresponding to said received code, when said received code is said n-th font conversion code;

reading corresponding font data by accessing the calculated address of said n-th font location; and providing a visual display of the read font data on said display unit.

2. The pager of claim 1, further comprised of said read font data representing characters in a bold style.

3. A pager, comprising:

means for sequentially detecting a code forming a text message of a paging signal;

a first font memory having a plurality of predetermined addresses, for storing a first font corresponding to said predetermined addresses;

an n-th font memory having said plurality of predetermined addresses, for storing an n-th font that is different from said first font, wherein $n \geqq 2$; and a controller for determining whether a detected code is an n-th font conversion code by comparing said detected code with a pre-selected n-th font conversion code, for calculating a corresponding address of said n-th font memory by adding a difference value between address ranges of said first font memory and said n-th font memory to an actual address of said first font memory corresponding to said detected code, when said detected code is said n-th font conversion code, and for reading corresponding font data by accessing the calculated address of said n-th font memory and providing a visual display of the read font data.

4. The pager of claim 3, further comprised of said read font data representing characters in a bold style.

5. A method of providing a visual display of a text message in different fonts in a pager, comprising the steps of:

receiving a paging signal including a pager number and a text message at said pager comprising an input unit including a font setting key and a plurality of discrete keys, a display unit, a memory including a first font location with a plurality of addresses for storing a first font, and a second font location with said plurality of addresses for storing a second font different from said first font;

comparing the pager number included in said paging signal with a pager number assigned to said pager for beginning operation of the pager when the two pager numbers coincide;

determining whether a received code forming said text message from said paging signal indicates a font conversion code;

when the received code forming said text message does not indicate said font conversion code, providing a visual display of said text message in said first font after accessing said plurality of addresses of said first font location for said first font;

when the received code forming said text message indicates said font conversion code, providing a visual display of said text message in said second font after accessing said plurality of addresses of said second font location for said second font.

6. The method of claim 5, further comprised of said text message in said first font representing characters in a normal style, and said text message in said second font representing said characters in a bold style.

* * * * *